US006282398B1

(12) United States Patent
Higashi

(10) Patent No.: US 6,282,398 B1
(45) Date of Patent: Aug. 28, 2001

(54) FIXING APPARATUS

(75) Inventor: Yuichiro Higashi, Minato-ku (JP)

(73) Assignee: Nitto Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/446,611

(22) PCT Filed: Jun. 24, 1998

(86) PCT No.: PCT/JP98/02826

§ 371 Date: Mar. 13, 2000

§ 102(e) Date: Mar. 13, 2000

(87) PCT Pub. No.: WO99/00714

PCT Pub. Date: Jan. 7, 1999

(30) Foreign Application Priority Data

Jun. 9, 1997 (JP) ..... 9-186042

(51) Int. Cl.[7] ..... G03G 15/20
(52) U.S. Cl. ..... 399/329; 219/216
(58) Field of Search ..... 399/328, 329, 399/322; 219/216, 243, 388

(56) References Cited

U.S. PATENT DOCUMENTS 5,289,248 * 2/1994 Kurokawa ..... 219/216 X
5,666,623 * 9/1997 Yamada et al. ..... 219/216 X
5,778,294 * 7/1998 Hiraoka et al. ..... 399/329
6,055,390 * 4/2000 Kurotaka et al. ..... 399/329 X

FOREIGN PATENT DOCUMENTS 3-12683 1/1991 (JP) .
5-127551 5/1993 (JP) .
8-262892 10/1996 (JP) .
8-339133 12/1996 (JP) .

* cited by examiner

*Primary Examiner*—Sophia S. Chen
(74) *Attorney, Agent, or Firm*—Armstrong, Westerman, Hattori, McLeland & Naughton, LLP

(57) ABSTRACT

The fixing apparatus is capable of ensure the freedom of the design for a driving mechanism which is provided for endlessly traveling the fixing belt. In order to accomplish the object, the fixing apparatus has a fixing roller (22), a pressing roller (24) being rollingly contacted the fixing roller (22), a heating roller (28) positioned upstream side of the fixing roller (22) with respect to a feeding direction in which a sheet (S) carrying an unfixed toner image thereon is fed and having a heating source therein, a fixing belt (32) trained around the heating roller (28) and the fixing roller (22) for transferring heat from the heat source to preheat the unfixed toner image on the sheet (S) before the sheet (S) passes through a rolling contact region defined between the fixing roller (22) and pressing roller (24), and a driving mechanism (44) for rotatably driving the pressing roller (24).

21 Claims, 7 Drawing Sheets

FIXING APPARATUS

FIELD OF TECHNOLOGY

The present invention relates to a fixing apparatus which is used for fusing and pressing an unfixed toner carried on a recording medium to fix the toner to the recording medium in, for example, an electric image forming apparatus.

TECHNICAL BACKGROUND

Recently, a fixing apparatus for use in an electric image forming apparatus has been developed which is illustrated in FIG. 10 of the accompanying drawings as a technology disclosed in Japanese Patent Application Laid-Open Publication HEI 6-318001, for example, not employing a conventional heating roller type fixing system. As shown in FIG. 10, the fixing apparatus is provided with a fixing roller R1, a heating roller R3, and an endless fixing belt B trained around the rollers R1 and R3, and a pressing roller R2 disposed below and pressed against the fixing roller R1 with the fixing belt B interposed therebetween. In the fixing apparatus disclosed in the Laid-Open Publication, it is combined with a preheat of a recording medium D.

Since the recording medium D is preheated, the nipping region may be set to a relatively low temperature. The fixing belt B is of such a small heat capacity that when the recording medium D passes through the nipping region, the temperature of the fixing belt B is quickly lowered to increase the coherent ability of the toner which is separated from the fixing belt B at the outlet of the nipping region, for thereby allowing the toner to be easily separated from the fixing belt B. Even if the fixing belt B is free of oil or coated with a small amount of oil, a clear fixed toner image can be produced on the recording medium D without offsets. The fixing apparatus shown in FIG. 10 is thus capable of solving the problems of toner separation and oil coating, which have not been eliminated by other fixing apparatus using only a heating roller.

Here, the conventional fixing apparatus shown in FIG. 10 will be described in more detail. The fixing apparatus is provided with a fixing roller R1, a pressing roller R2, a heating and tensioning roller R3, and an endless fixing belt B trained around the rollers R1 and R3. There is provided an oil coating roller R4 disposed above the upper run of the fixing belt B, and a guide plate G for supporting the recording medium D disposed below a lower run of the fixing belt B with a predetermined gap therebetween. The gap between the guide plate B and the lower run of the fixing belt B serves as a preheating passage P for preheating the recording medium D.

There is provided a heater H which is housed in the heating and tensioning roller R3. Further, additional heater may be housed in fixing roller R1 and/or pressing roller R2. There is also provided a thermistor T which contacts a non-passage portion of the fixing belt B in order to control the temperature of the fixing belt B.

However, in the conventional belt-type fixing apparatus having above mentioned construction, it is preferable to rotate a driving roller for endlessly traveling the fixing belt B, which is rotatable about a stationary rotating axis. From the present point, it is constructed that the fixing roller R1 to which the pressing roller R2 is pressed is set to be rotatably driven. When it is limited that the fixing roller R1 is only set as the driving roller for endlessly traveling the fixing belt B, this causes certain restrictions of design for, for example, a power transmission path or route of the driving force, a location of a driving source, being thereby failing to ensure the freedom of the design. Therefore, it has been desired to obviate this drawback.

Accordingly, it is a primary object of the present invention to provide a fixing apparatus which is capable of ensuring the freedom of the design for a driving mechanism which is provided for endlessly traveling the fixing belt.

DISCLOSURE OF THE INVENTION

In order to solve the aforementioned problems and accomplish the above object, an inventive fixing apparatus comprises a fixing roller, a pressing roller being rollingly contacted the fixing roller, a heating roller positioned upstream side of said fixing roller with respect to a feeding direction in which a sheet carrying an unfixed toner image thereon is fed, a heating source being remote from said fixing roller, a fixing belt trained around said heating roller and said fixing roller for transferring heat from said heat source to preheat the unfixed toner image on said sheet before said sheet passes through a rolling contact region defined between said fixing roller and pressing roller, and driving means for rotatably driving said pressing roller to endlessly travel the fixing belt upon the rotation of said pressing roller.

In the inventive fixing apparatus, said pressing roller is movably attached along a direction crossing to said feeding direction at least.

In the inventive fixing apparatus, urging means for urging the pressing roller toward the fixing roller so as to contact thereto is further provided.

In the inventive fixing apparatus, said driving means includes a driven gear coaxially fixed to said pressing roller, and a driving gear intermeshed with said driven gear, said driven gear is constructed so as to revolve around the driving gear with maintaining the intermeshing condition between the driving gear and driven gear.

In the inventive fixing apparatus, said driving gear is rotatably supported about a predetermined stationary axis, and said driven gear is rotatably supported on the distal end of a swing arm, the proximal end of said swing arm being rotatably supported about said predetermined stationary axis.

In the inventive fixing apparatus, said fixing belt includes an endless belt base of a heat transmission material and a separating layer coated on an outer circumferential surface of the endless belt base.

In the inventive fixing apparatus, said endless belt base is made of metal belt.

In the inventive fixing apparatus, said endless belt base is made of electro-formed nickel.

In the inventive fixing apparatus, said endless belt base is made of synthetic resin.

In the inventive fixing apparatus, said synthetic resin has an electro-conductivity.

In the inventive fixing apparatus, said endless belt base is made of polyimide.

In the inventive fixing apparatus, said poly-imide has an electro-conductivity.

In the inventive fixing apparatus, said heating source is housed in said heating roller, and said fixing belt is heated by the heating roller which is heated by said heating source.

BEST MODE FOR CARRYING OUT THE INVENTION

{General description of fixing apparatus}

Figure 1:
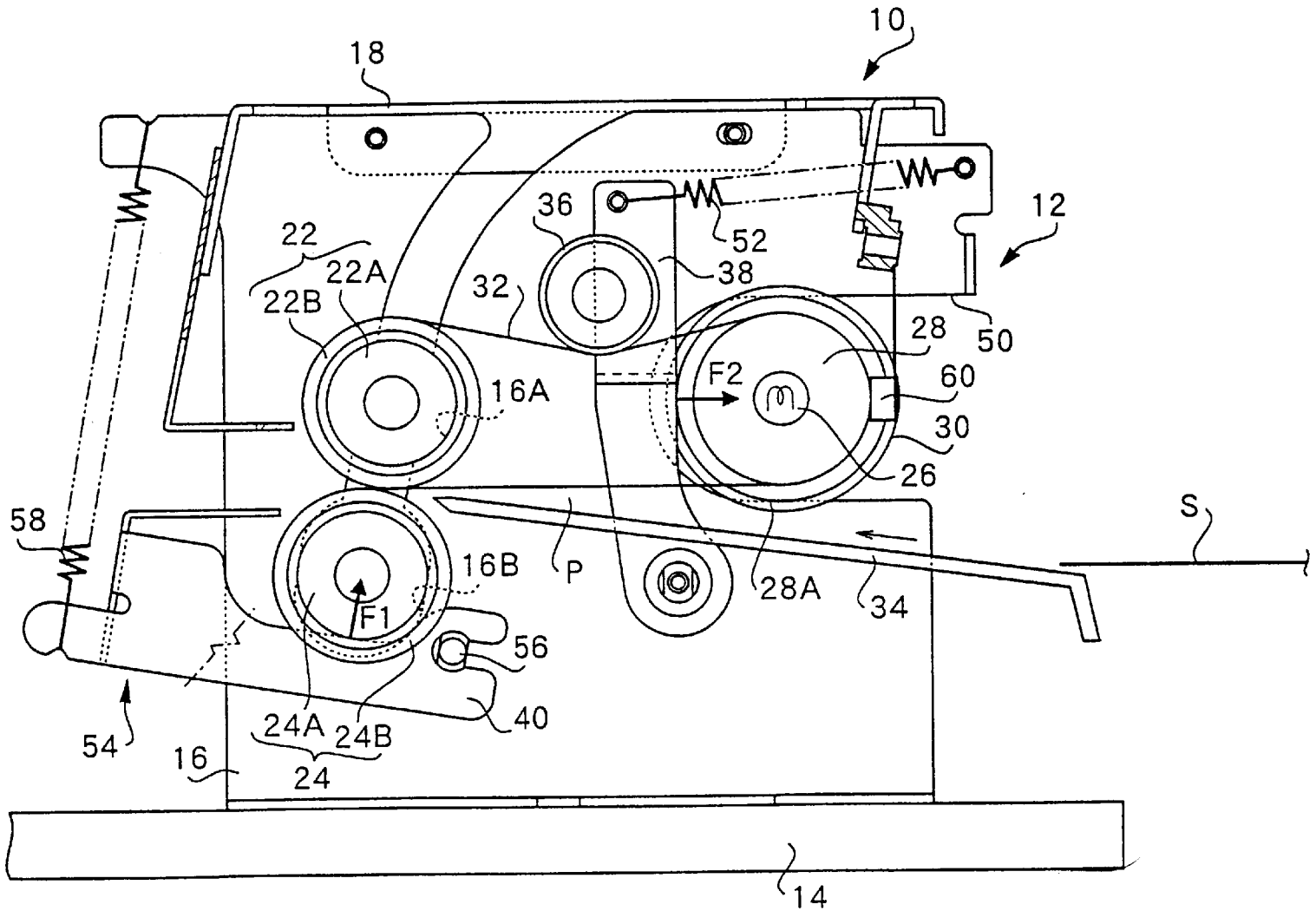
FIG. 1 is a front view schematically showing a total construction of the fixing apparatus according to one embodiment of the present invention.

As shown in FIG. 1, a fixing apparatus 10 of an electric image forming apparatus (hereinafter, simply referred to "fixing apparatus") according to one embodiment of the present invention has a housing 12 to be fixed to a frame of an electronic image forming system (not shown). The housing 12 is provided with a base plate 14 to be fixed directly to the frame, a pair of vertical mounting stays 16 directly erected from respective side edges of the base plate 14, and an ceiling plate 18 connecting between the upper portions of the mounting stays 16.

It should be noted that the left direction indicated by an arrow in the drawing is defined as a feeding direction in which an unfixed sheet S on which an unfixed toner image is carried is fed. That is to say, the aforementioned mounting stays 16 are positioned so as to stand on right and left sides of the unfixed sheet S which is to be fed in the feeding direction and each of the mounting stays 16 extends in the feeding direction.

The fixing apparatus 10 has a roller assembly including a fixing roller 22 rotatably supported on the mounting stays 16 for being rotatable about its own central axis, a pressing and driving roller 24 (hereinafter, simply referred to "pressing roller") positioned below the fixing roller 22 in rolling contact therewith, rotatably supported on the mounting stays 16 for rotation about its own central axis and movably supported to the mounting stays 16 in a vertical direction, and a heating roller 28 arranged on the upstream side of the fixing roller 22 with respect to the feeding direction of the unfixed sheet S, being movably supported on the mounting stays 16 in the feeding direction and having a heating source 26 such as a halogen lamp therein.

Furthermore, the fixing apparatus 10 is provided with an endless fixing belt (heat transfer belt) 32 which is trained around the fixing roller 22 and the heating roller 28 and a guide plate 34 which is positioned below the fixing belt 32, for guiding the unfixed sheet S transferred from the image forming apparatus through a transfer mechanism (not shown) to a rolling contact region (nipping region) between the fixing belt 32 and the pressing roller 24. The gap between the guide plate 34 and the fixing belt 32 serves as a preheating passage P for preheating the unfixed sheet S.

The fixing apparatus 10 is also provided with an oil applying roller 36 for constantly maintaining the tension of the fixing belt 32, applying silicone oil to an outer circumferential surface of the fixing belt 32 and cleaning the outer surface of the fixing belt 32, a tension lever 38 for urging the heating roller 28 so as to separate from the fixing roller 22, thereby applying a predetermined tension to the fixing belt 32 in cooperation with the oil applying roller 36, and a pressure lever 40 for urging the pressing roller 24 so as to approach it to the fixing roller 22, thereby pressing the pressing roller 24 to the fixing roller 22 through the fixing belt 32.

In the fixing apparatus 10 with such a construction, the unfixed sheet S which are transferred on the guide plate 34 is further transferred to the rolling contact region defined between the fixing belt 32 and pressing roller 24. Since the unfixed sheet S is passing through the rolling contact region with a high pressure, the toner on the sheet S is fused and pressed onto the sheet S to be fixed thereon.

Here, in the fixing apparatus 10, the transferring speed of the unfixed sheet S is set to be within a range from 10 mm/sec to 500 mm/sec, and the gap of the preheating passage P is set to be within a range from 0.5 mm to 20 mm, and various values are settled so as to satisfy condition wherein a preheating time for passing through a distance between the centers of fixing roller 22 and heating roller 28 is to be set within a range from 0.1 sec to 4 sec.

{Description of fixing roller 22}

The fixing roller 22 includes a core 22A rotatably supported in circular first supporting holes 16A formed on the mounting stays 16 by bearings and a roller body 22B which is fitted coaxially over the core 22A and around which the fixing belt 32 is trained. The fixing roller 22 has an outside diameter of 20 mm in this embodiment. The core 22A is formed by a shaft of iron having a diameter of 12 mm, and the roller body 22B is made of a heat-resistant resilient material of silicone rubber (especially, silicone rubber sponge having ASKER C hardness of 30 degrees) having a wall thickness of 4 mm.

{Description of pressing roller 24}

The pressing roller 24 includes a core 24A rotatably supported in elongated and arcuate second supporting holes 16B, which is formed on the mounting stays 16 so as to extend vertically, by bearings and movable in the extending direction thereof, and a roller body 24B fitted coaxially over the core 24A. The pressing roller 24 has an outside diameter of 20 mm in this embodiment. The core 24A comprises a shaft of iron having a diameter of 14 mm, and the roller body 24B is made of a heat-resistant resilient material of silicone rubber (specifically, the roller body 24B is made of silicone rubber sponge having a JIS Model A hardness of 40 degrees, which is harder than the fixing roller 22) having a wall thickness of 3 mm.

Figure 3:
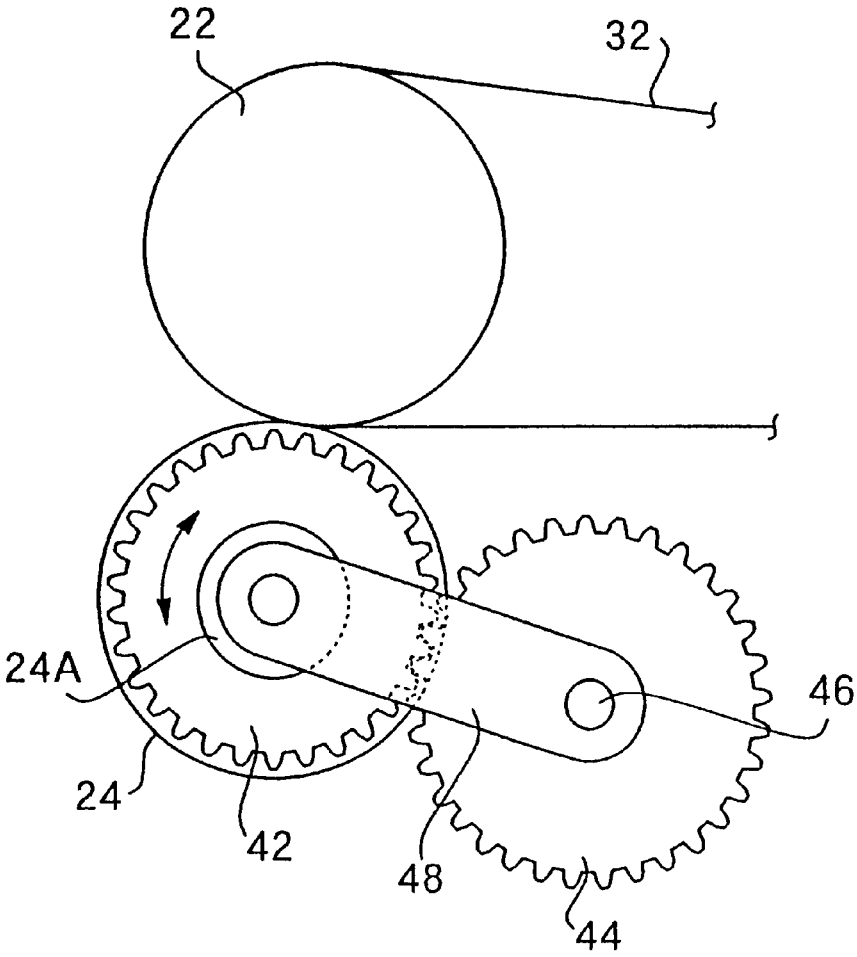
FIG. 3 is a front view of an attaching construction of the pressing roller.
Figure 4:
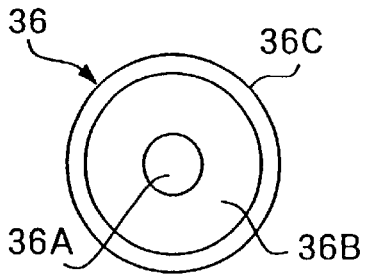
FIG. 4 is a front view of the oil coating roller which is used in the fixing apparatus shown in FIG. 1.

On the other hand, the pressing roller 24 is constructed so as to function as a driving roller in the embodiment. As shown in FIG. 3, the core 24A of the pressing roller 24 has one end combined with a driven gear 42 which is coaxially fixed thereto. A driving gear 44 which constitutes a driving mechanism (that is, driving means) which is not shown in detail is held in mesh with the driven gear 42. The driving gear 44 is rotated by driving forces from a driving source (not shown) through a driving force transmitting mechanism (not shown). Drive forces are transmitted from the driving gear 44 to the driven gear 42, which rotates the pressing roller 24.

More specifically, the driving gear 44 is rotatably supported to a supporting shaft 46 which is fixed to the mounting stays 16. To the supporting shaft 46, one end (proximal end) of a revolving arm 48 is attached so as to be capable to revolve. To the other end (distal end) of the revolving arm 48, the core 24 of the pressing roller 24 is rotatably supported. The driven gear 42 and driving gear 44 are formed so as to have the same module, and mesh with each other. Accordingly, the driven gear 42 is rotated upon the rotation of the driving gear 44 as well as the driven gear 42 is capable to revolve around the driving gear 44, with maintaining the driving force transmitting condition.

The core 24A of the pressing roller 24 is inserted into the second supporting holes 16B formed to the mounting stays 16, and the second supporting holes 16B are formed in such a manner that it guides the revolving movement of the core 24A of the pressing roller 24 (that is to say, to guide the pressing roller 24 to be movable in a direction crossing to the feeding direction at least). Accordingly, the second supporting holes 16B is formed to have an arcuate shape about the supporting shaft 46 as a center and a radius defined by a distance between the core 24A and the shaft 46.

It should be noted that the silicone rubber heat-resistant resilient material is exposed on the outer circumferential surface of the pressing roller 24. As a result, the outer circumferential surface of the pressing roller 24 and the outer circumferential surface of the fixing belt 32 are frictionally engaged with each other through the silicone rubber surface when the pressing roller 24 is once rotated, accordingly the rotation of the pressing roller 24 is stably transmitted to the fixing belt 32 and the fixing belt 32 is endlessly run in a good condition.

{Description of heating roller 28}

Figure 2:
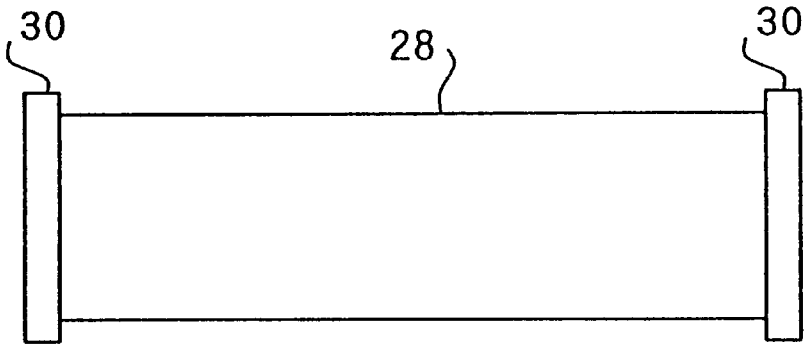
FIG. 2 is a side view of the heating roller which is used in the fixing apparatus shown in FIG. 1.

In this embodiment, as the heat source 26 in the heating roller 28, there is provided a 600 W halogen lamp which is designed to emit light at an intensity that is 50% greater in opposite end regions than in a central region thereof. The heating roller 28 includes a core in the form of an aluminum pipe having a diameter of 20 mm and a wall thickness of 1.75 mm. The outer circumferential surface of the core is treated by alumite. Coaxially fixed to the both ends of the heating roller 28 are supporting shaft portions 28A which are rotatably inserted into guide grooves 50 formed on the mounting stays 16 so as to extend horizontally. As shown in FIG. 2, a circular collar 30 made of heat-resistant polyetheretherketone (PEEK) and having a diameter of 24 mm is press-fitted over each of opposite supporting shaft portions 28A for preventing the fixing belt 32 from being tortured or displaced out of position on the heating roller 28.

{Description of fixing belt 32}

The fixing belt 32 preferably has a heat capacity of 0.002 cal/° C.–0.025 cal/° C. per $cm^2$ so as to be able to preheat the unfixed toner on the unfixed sheet S to a fixing temperature through heat radiation for thereby fixing the toner. In this embodiment, the fixing belt 32 includes an endless belt base made of electro-formed nickel having a thickness of 40 $\mu$m and an inner diameter of 50 mm and a heat-resistant resilient separating layer of silicone rubber that is coated to a thickness of 150 $\mu$m on an outer circumferential surface of the endless belt base.

{Description of oil applying roller 36}

The oil applying roller 36 serves to apply a small amount of silicone oil to the outer circumferential surface of the fixing belt 32 for separating the sheet S easily from the fixing belt 32. The oil applying roller 36 includes a support shaft 36A rotatably supported in a mounting stays 16 through bearings (not shown) and a heat-resistant layer 36B of paper fitted over the support shaft 36A and impregnated with silicone oil. In this embodiment, the support shaft 36A comprises a shaft of iron having a diameter of 8 mm, and the heat-resistant layer 36B of paper is covered with a film 36C of porous fluoroplastics having a thickness of 100 $\mu$m. The oil applying roller 36 has a diameter of 14 mm.

The oil applying roller 36 thus constructed is capable of stably applying a small amount of silicone oil to the outer circumferential surface of the fixing belt 32.

Figure 5:
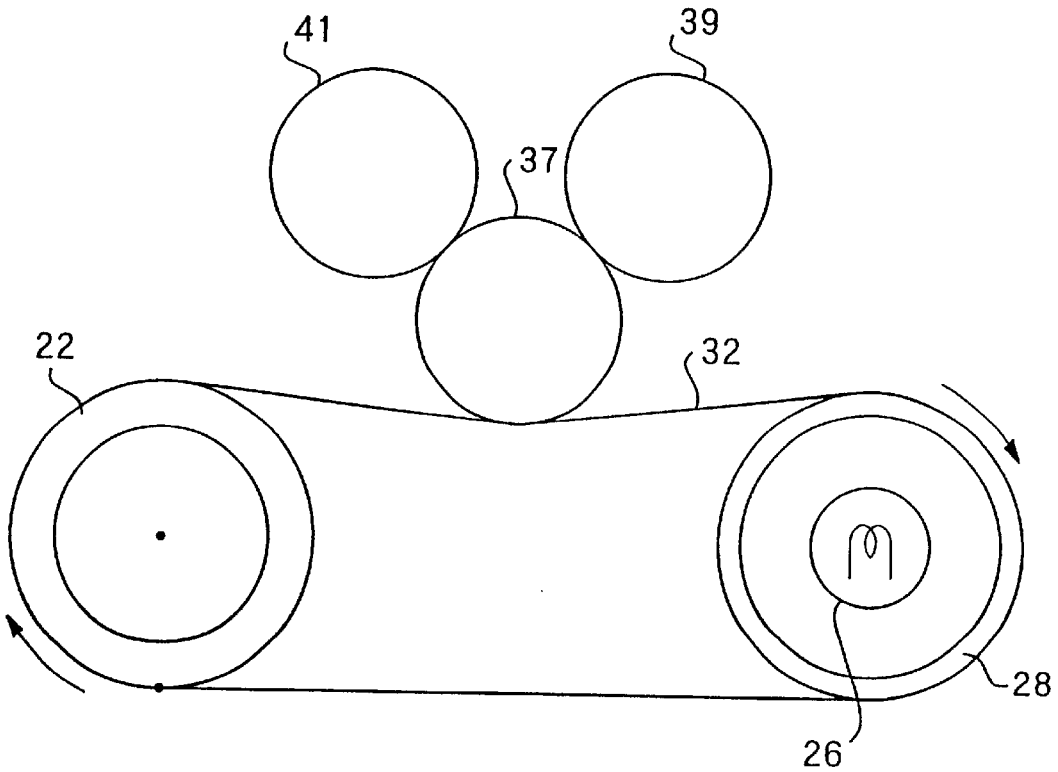
FIG. 5 is a front view of a construction including a fixing belt/oil coating/cleaning mechanism for coating the oil onto the fixing belt, being different from the construction including oil coating roller shown in FIG. 4.

It should be noted that the construction for applying the oil to the fixing belt 32 is not limited to the construction having the oil applying roller 36. For example, as shown in FIG. 5, it is possible to use a fixing belt/oil applying/cleaning mechanism including 3(three) rollers construction, that is, a donating roller 37 which has a metal core and a heat resistant resilient material of silicone rubber fitted over the metal core, for applying the oil to the fixing belt 32 and cleaning it, a cleaning roller 39 which has a metal core and a synthetic skin fitted over the metal core, and an oil coating roller 41 which has a metal core and a layer formed by an unwoven cloth impregnated with silicone oil or layers superposed by a layer formed by an unwoven cloth and a layer formed by a synthetic skin, fitted over the metal core.

{Description of tensioning mechanism for the fixing belt 32}

On the other hand, as a mechanism for tensioning the fixing belt 32, the fixing apparatus 10 is provided with a tension lever 38, as shown in FIG. 1. The tension lever 38 is swingably supported to the mounting stays 16 at its lower end, and connected to one end of the mounting stays 16 at its upper end through a tension spring 52. By the urging force of the tension spring 52, the tension lever 38 is urged to rotate so as to contact with the outer circumferential surface of the heating roller 28 at its intermediate portion by a predetermined urging force F2.

Namely, the heating roller 28 urged by the urging force of the tension spring 52 through the tension lever 38 is biased to move so as to separate from the fixing roller 22 along the guide groove 50. Thus, the upper run of the fixing belt 32 trained around the heating roller 28 and fixing roller 22 is restricted by the oil applying roller 36, thereby tensioning the fixing belt 32. When the fixing belt 32 is driven by the pressing roller 24, the fixing roller 28 is stably driven thereby without slipping or sagging with respect to the fixing belt 32.

{Description of pressing mechanism between fixing belt 32 and pressing roller 24}

Next, a description of a pressing mechanism 54 for pressing the fixing belt 32 and pressing roller 24 with each other by a predetermined urging force at a position where the fixing belt 32 starts to be trained around the fixing roller 22, will be given. The pressing mechanism 54 is provided with a pressure lever 40 which is rotatably supported to the mounting stays 16 at one end through a supporting shaft 56 and capable of abutting against the core 24A of the pressing roller 24 from below, and a pressure spring 58 a lower end of which is coupled to the other end of the pressure lever 40 and an upper end of which is coupled to the upper portion of the mounting stay 16. By the urging force of the pressure spring 58, the pressure lever 40 contacts the outer circumferential surface of the core 24A of the pressing roller 24 by a predetermined force F1. As a result, the fixing belt 32 trained around the fixing roller 22 and the pressing roller 24 are contacted with each other by a predetermined urging force. That is to say, the fixing belt 32 and the pressing roller are rolling contacted with each other having a predetermined nip width.

Here, in the embodiment, a positional relationship between the fixing roller 22 and pressing roller 24 is set so that the pressing roller 24 is inclined by a predetermined angle in clockwise direction from a vertical line passing through the central position of the fixing roller 22. Thus, the nipping position between the fixing belt 32 and pressing roller 24 (that is, the central position of the nip width) is defined so as to biased forward (that is, to the left direction in drawing) in the feeding direction of the unfixed sheet S from a position just below the central position of the fixing roller 22 slightly.

{Description of guide plate 34}

Figure 6:
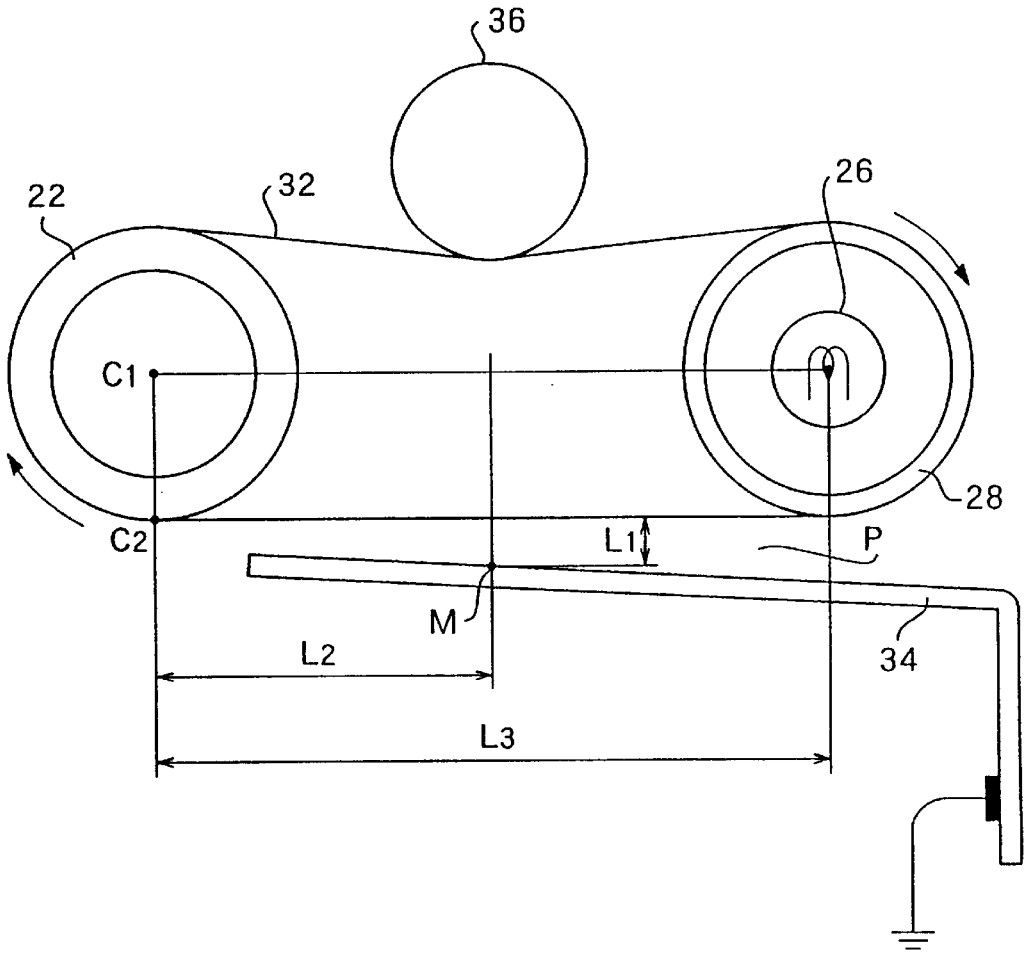
FIG. 6 is a front view showing a positional relationship between the guide plate and fixing belt shown in FIG. 1.

The fixing apparatus 10 is provided with the guide plate 34 for guiding the unfixed sheet S transferred by the transferring mechanism (not shown) to the rolling contacting region between the fixing belt 32 and the pressing roller 24. As shown in FIG. 6, the guide plate 34 is settled in such a manner that a gap L1 between the upper surface of the guide plate 34 and the lower run of the fixing belt 32 is set to 3 mm at a central position M which is defined by a crossing point of the upper surface of the guide plate 34 and the vertical line passing through an intermediate point between the heating roller 28 and fixing roller 22. Note that, in the embodiment, the distance L3 between the heating roller 28 and fixing roller 22 is set to 47 mm and a distance L2 between the central position M and a vertical line passing through the center of the fixing roller 22 is set to 23.5 mm.

Figure 7:
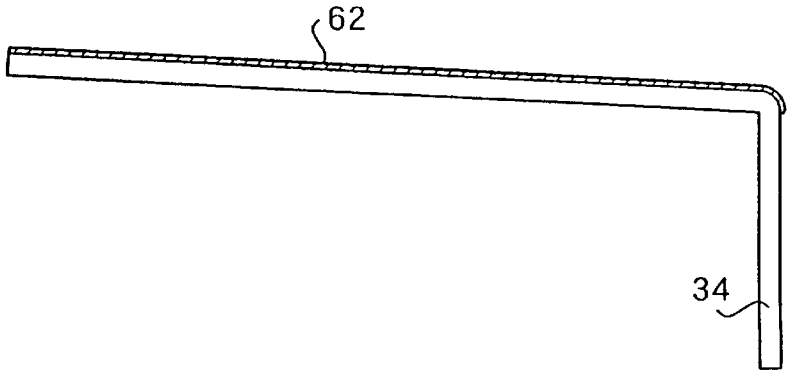
FIG. 7 is a front view of the construction of the guide plate shown in FIG. 1.

As shown in FIG. 7, the guide plate 34 is provided with a separating layer 62 formed of a fluoroplastics such as a PTFE (Polytetrafluoroethylene) etc., thereon. Although the guide plate 34, as shown in FIGS. 1 and 6, is grounded in order to disturb the unfixed toner image, this is not limited to such a construction but it will be possible to use an electrically erasing brush, a varistor element, and a diode etc., instead of the grounding.

On the other hand, it is settled that the lower run of the fixing belt 32 trained around the fixing roller 22 and heating roller 28 travels substantially in the horizontal direction, that is, to the left in the drawing. A distance between the guide plate 34 and the fixing belt 32 is set to be within a range of about 5 mm to 20 mm at a position just below the heating roller 28. That is to say, the guide plate 34 is set to be slant to the horizontal lower run of the fixing belt 32 such that it extends to the nip region in a slanted manner.

In other words, the lower run of the fixing belt 32 and the guide plate 34 define a so-called wedge shaped transferring space having the nip position as an apex. Accordingly, the unfixed sheet S is surely transferred to the nip position between the fixing belt 32 and the pressing roller 24 upon the conveyance on the guide plate 34. In the nipping region, the unfixed sheet S which has been already preheated by a heat radiation from the fixing belt 32 is pressed by a predetermined pressure F1 and heated by the heat of the fixing belt 32, whereby the unfixed toner on the unfixed sheet S it heatedly fixed thereon.

{Description of thermistor}

The fixing apparatus 10 is provided with a thermistor 60 for controlling the temperature of the fixing belt 32. In the embodiment, the thermistor 60 is constructed to contact a non-passage portion of the fixing belt 32, that is, the right side portion of the fixing belt 32 which it directly trained around the heating roller 28, to detect the surface temperature thereof. In other words, the thermistor 60 is electrically connected to a control unit (not shown) to transmit the temperature information of the fixing belt 32 to the control unit.

{Description of experiment where angle θ is altered}

Figure 8:
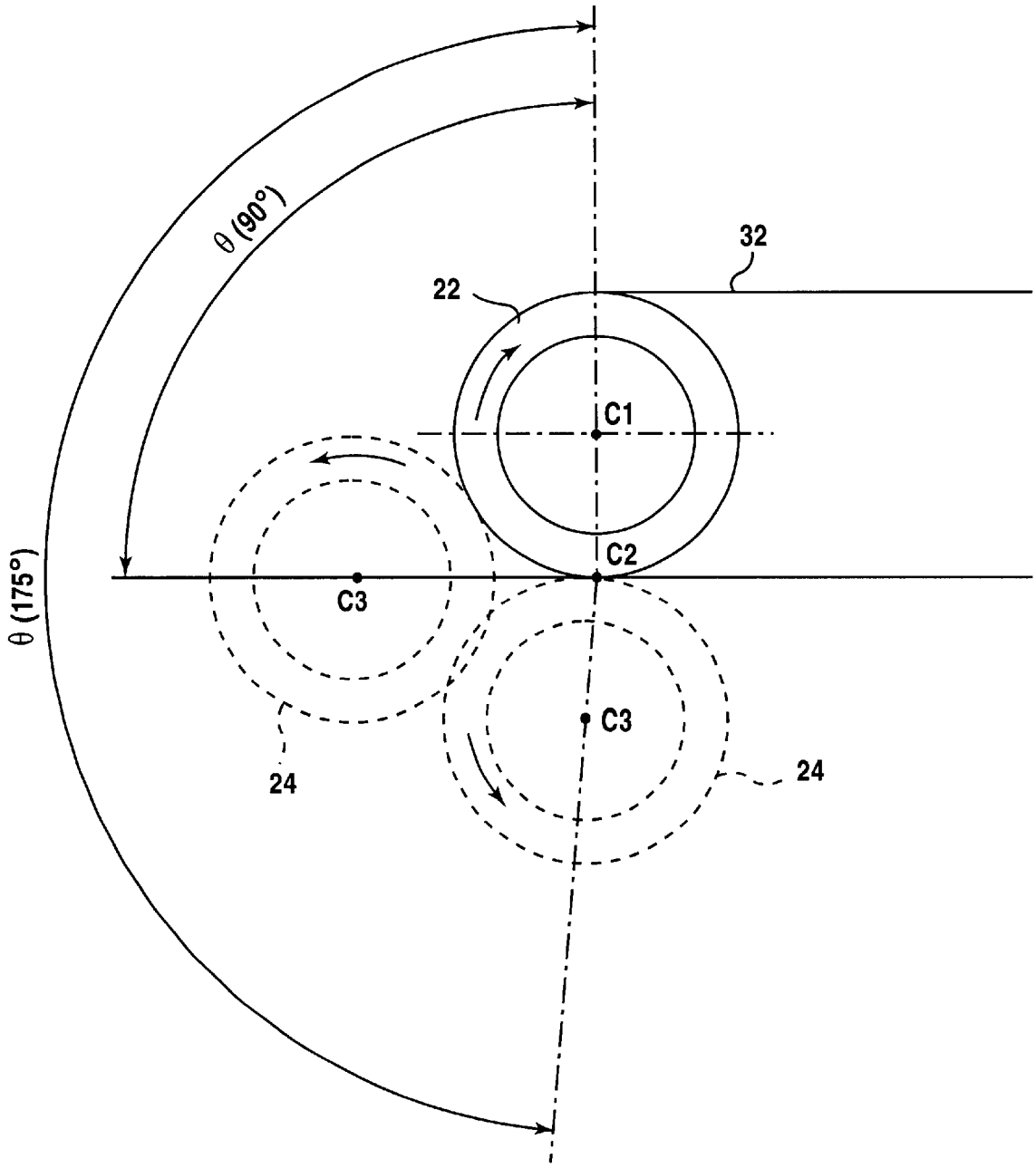
FIG. 8 is a front view showing a positional relationship between the fixing roller and the pressing roller.
Figure 9:
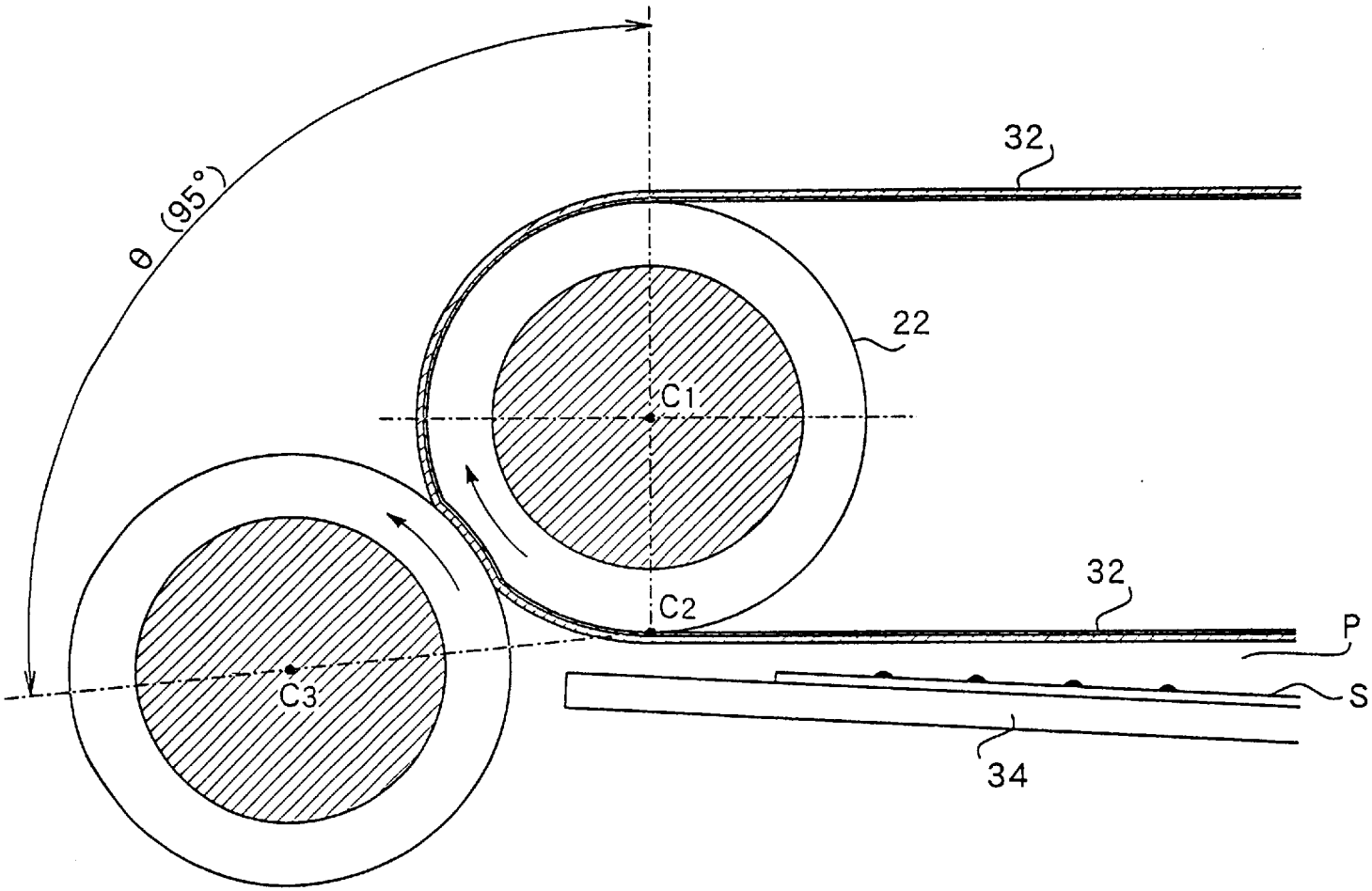
FIG. 9 is an enlarged front view of nipping portion.
Figure 10:
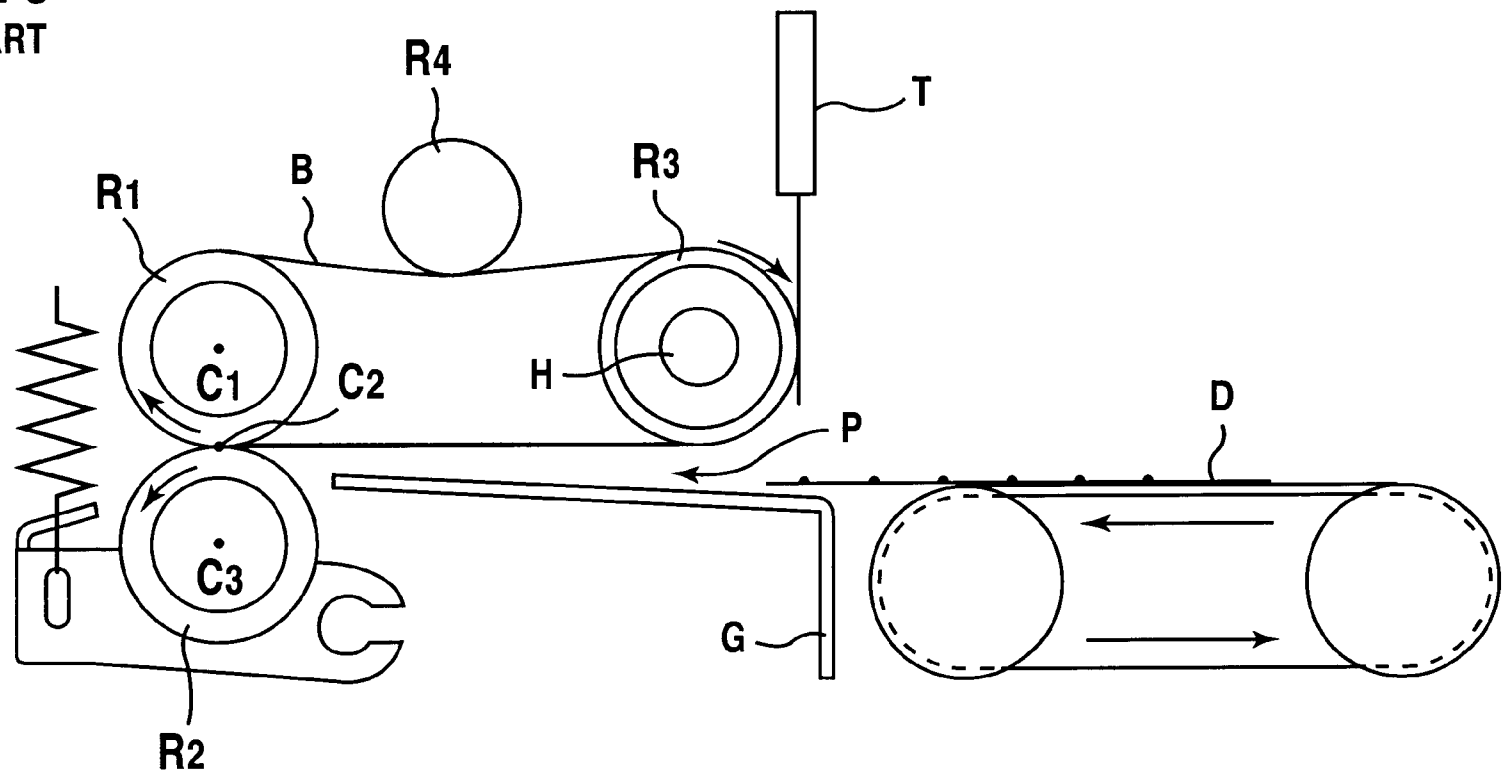
FIG.10 PRIOR ART
FIG. 10 is a front view schematically showing the conventional fixing apparatus.

As shown in FIGS. 8 and 9, assuming that the central point of the fixing roller 22 is "C1", a crossing point of a vertical line passing through the central point C1 and the fixing belt 32 is "C2", a central point of the pressing roller 24 is "C3", and an angle θ is defined by a line between C1 and C2 and a line between C2 and C3, the fixing apparatus 10 is modified in such a manner that the angle θ is set within a range from 90 degrees to 180 degrees by changing the location of the pressing roller 24 (in FIG. 8, the pressing roller 24 is shown in positions that the angle θs are 90 degrees, and 175 degrees). In the fixing apparatus 10 of the experiment, the hardness of the fixing roller 22 and the pressing roller 24 and the angle θ therebetween are changed, while the feeding speed of the unfixed sheet S is set to 70 mm/sec, the fixing pressure is set to 20 kgf, and the surface temperature of the fixing belt 32 is set to 160° C.

The experiments were executed in such a manner that the sheet on which the unfixed toner image formed by the toner for MINOLTA CF-70 was transferred was examined with respect to a disorder of the toner image and whether or not an unevenness of the glossiness was occurred, in cases of a use of a paper sheet with 55 kg as a first experiment, of a paper sheet with 68 kg as a second experiment, and of OHP film as a third experiment. In each experiment, the result was appreciated after 5(five) unfixed sheets were fixed by the fixing apparatus such that it was OK (○) when the disorder of the toner image and the unevenness of the glossiness were not occurred in all of the fixed sheets, that it was NG (X) when the disorder of the toner image and the unevenness of the glossiness were occurred in all of the fixed sheets, that it was of problem (Δ) when the disorder of the toner image and the unevenness of the glossiness were occurred in at least one fixed sheet, and that it was of problem (▲) when the at least one fixed sheet was wound around the fixing belt 32. The results of the experiments are shown in tables 1 through 3 as follows.

TABLE 1

| Combination of rubber hardness (JIS A) | | Oblique angle of pressing roller (degrees) | | | | | | | | | |
|---|---|---|---|---|---|---|---|---|---|---|---|
| Rubber hardness of fixing roller | Rubber hardness of pressing roller | 180 | 175 | 160 | 150 | 140 | 135 | 125 | 110 | 100 | 90 |
| 25° | 25° | × | Δ | ○ | ○ | ○ | ○ | ○ | ▲ | It was unable | |
| 25° | 40° | × | Δ | ○ | ○ | ○ | ○ | ○ | ○ | to judge | |
| 25° | 60° | × | Δ | ○ | ○ | ○ | ○ | ○ | ○ | since fixed | |
| 40° | 25° | × | × | × | × | ○ | ○ | ○ | ▲ | sheet came to | |
| 40° | 40° | × | × | × | × | ○ | ○ | ○ | ○ | be wound | |
| 40° | 60° | × | Δ | ○ | ○ | ○ | ○ | ○ | ○ | around fixing | |

TABLE 1-continued

| Combination of rubber hardness (JIS A) | | Oblique angle of pressing roller (degrees) | | | | | | | | | |
|---|---|---|---|---|---|---|---|---|---|---|---|
| Rubber hardness of fixing roller | Rubber hardness of pressing roller | 180 | 175 | 160 | 150 | 140 | 135 | 125 | 110 | 100 | 90 |
| 60° | 25° | × | × | × | × | × | ○ | ○ | ▲ | belt | |
| 60° | 40° | × | × | × | × | × | ○ | ○ | ▲ | | |
| 60° | 60° | × | × | × | × | ○ | ○ | ○ | ○ | | |

TABLE 2

| Combination of rubber hardness (JIS A) | | Oblique angle of pressing roller (degrees) | | | | | | | | | |
|---|---|---|---|---|---|---|---|---|---|---|---|
| Rubber hardness of fixing roller | Rubber hardness of pressing roller | 180 | 175 | 160 | 150 | 140 | 135 | 125 | 110 | 100 | 90 |
| 25° | 25° | Δ | ○ | ○ | ○ | ○ | ○ | ○ | ○ | ○ | ○ |
| 25° | 40° | Δ | ○ | ○ | ○ | ○ | ○ | ○ | ○ | ○ | ○ |
| 25° | 60° | Δ | ○ | ○ | ○ | ○ | ○ | ○ | ○ | ○ | ○ |
| 40° | 25° | Δ | ○ | ○ | ○ | ○ | ○ | ○ | ○ | ○ | ○ |
| 40° | 40° | Δ | ○ | ○ | ○ | ○ | ○ | ○ | ○ | ○ | ○ |
| 40° | 60° | Δ | ○ | ○ | ○ | ○ | ○ | ○ | ○ | ○ | ○ |
| 60° | 25° | × | × | ○ | ○ | ○ | ○ | ○ | ○ | ○ | ○ |
| 60° | 40° | × | × | ○ | ○ | ○ | ○ | ○ | ○ | ○ | ○ |
| 60° | 60° | × | × | ○ | ○ | ○ | ○ | ○ | ○ | ○ | ○ |

TABLE 3

| Combination of rubber hardness (JIS A) | | Oblique angle of pressing roller (degrees) | | | | | | | | | |
|---|---|---|---|---|---|---|---|---|---|---|---|
| Rubber hardness of fixing roller | Rubber hardness of pressing roller | 180 | 175 | 160 | 150 | 140 | 135 | 125 | 110 | 100 | 90 |
| 25° | 25° | Δ | ○ | ○ | ○ | ○ | ○ | ○ | ○ | ○ | ○ |
| 25° | 40° | Δ | ○ | ○ | ○ | ○ | ○ | ○ | ○ | ○ | ○ |
| 25° | 60° | Δ | ○ | ○ | ○ | ○ | ○ | ○ | ○ | ○ | ○ |
| 40° | 25° | Δ | ○ | ○ | ○ | ○ | ○ | ○ | ○ | ○ | ○ |
| 40° | 40° | Δ | ○ | ○ | ○ | ○ | ○ | ○ | ○ | ○ | ○ |
| 40° | 60° | Δ | ○ | ○ | ○ | ○ | ○ | ○ | ○ | ○ | ○ |
| 60° | 25° | × | × | ○ | ○ | ○ | ○ | ○ | ○ | ○ | ○ |
| 60° | 40° | × | Δ | ○ | ○ | ○ | ○ | ○ | ○ | ○ | ○ |
| 60° | 60° | Δ | ○ | ○ | ○ | ○ | ○ | ○ | ○ | ○ | ○ |

In the first experiment shown in the table 1, the result was substantially good in a case where the angle θ was within a range from 125 degrees to 140 degrees. However, it would be understood that it tenders to gradually occur the unevenness of glossiness of the toner image in a case where the angle θ was set to become larger than 140 degrees. Further, the fixed sheet would occasionally be wound around the fixing belt 32 in a case where the angle θ was set become smaller than 110 degrees. Specifically, the fixed sheet was stuck to the fixing belt 32 to be wound therearound in a case where the angle θ was 100 degrees or 90 degrees, whereby it was unable to judge the fixed image performance. It should be noted that it would be clear the possibility of occurring the no-good of glossiness of the toner image would be higher in a case where the rubber hardness of the fixing roller 22 was higher than that of the pressing roller 24 and the difference therebetween was set to be larger.

In the second experiment shown in the table 2, the result was good in the toner image, the unevenness of the glossiness of the toner image being not occurred except for a case where the angle θ was 175 degrees or 180 degrees. The unevenness of the glossiness of the toner image occurred in a case where the angle θ was 175 degrees or 180 degrees, and the rubber hardness of the fixing roller 22 is set to be 60 degrees, while the unevenness of the glossiness of the toner image occurred in a case where the rubber hardness of the fixing roller 22 is set to be 60 degrees. Further, the unevenness of the glossiness of the toner image certainly occurred in a case where the angle θ was 180 degrees nevertheless the hardnesses of the fixing roller 22 and the pressing roller 24, while the unevenness of the glossiness of the toner image surely occurred in a case where the rubber hardness of the fixing roller 22 is set to be 60 degrees.

In the third experiment shown in the table 3, the result was substantially the same as in the second experiment.

As a result, it is clear that the angle θ from 125 degrees to 160 degrees is preferable from the first through third experiments. Thus, the fixing belt 32 is stably traveled even though the pressing roller 24 functions as a driving roller for driving to travel the fixing belt 32. Furthermore, it is possible to search the most suitable fixing condition by changing the angle θ. Accordingly, since it is possible to travel the fixing belt 32 by the pressing roller 24, it would be enable to improve the freedom of the design when the drive mechanism for travel the fixing belt 32 is designed.

{Description of other embodiment}

It should be noted that the present invention is not limited to such a construction of the aforesaid embodiment, and a variety of modifications can be made without departing from the spirit and scope of the present invention.

For example, although only the pressing roller 24 is set to be movable in a direction at least crossing to the feeding direction of the sheet in the aforementioned embodiment, the present invention is not limited to such a construction and it is possible that the pressing roller 24 to which the driven gear 42 is fixed and the driving gear 44 with which the driven gear 42 is intermeshed are attached to a sub-frame in a rotatable manner, and the sub-frame is attached to the mounting stay 16 in a movable manner. In the case, it may be possible to support the sub-frame to be movable in a direction crossing to the feeding direction of the sheet by employing an endless belt (or, endless chain) as a member for transmitting the driving force to the driving gear 44, and applying a tension to the endless transmitting member from a tension applying mechanism.

Further in the aforementioned embodiment, although the heating source 26 such as a halogen lamp is housed in the heating roller 28, the present invention is not limited to such a construction and the heating source may be provided out of the heating roller 28 while directly heating the fixing belt 32.

Industrial Applicability

As described in detail above, the present invention provide the fixing apparatus which is capable of ensure the freedom of the design for a driving mechanism which is provided for endlessly traveling the fixing belt, by employing a mechanism wherein the pressing roller is rotatably driven to travel the fixing belt. Thus, the fixing apparatus according to the present invention is suitable to be installed in the image forming apparatus such as an electrical copying machine, electrical printing machine, electrical facsimile machine, etc.

What is claimed is:

1. A fixing apparatus, comprising:

a fixing roller, a pressing roller rollingly contacting the fixing roller, a heating roller positioned on an upstream side of said fixing roller with respect to a feeding direction in which a sheet carrying an unfixed toner image thereon is fed, a heating source being remote from said fixing roller, a fixing belt trained around said heating roller and said fixing roller for transferring heat from said heating source to preheat the unfixed toner image on said sheet before said sheet passes through a rolling contact region defined between said fixing roller and pressing roller, driving means for rotatably driving said pressing roller to endlessly travel the fixing belt upon the rotation of said pressing roller, and a pressing mechanism for urging said pressing roller toward said fixing belt, said pressing roller being inclined by a predetermined angle in a feeding forward direction with respect to a vertical line passing through a central position of said fixing roller.

2. The fixing apparatus according to the claim 1, wherein said pressing roller is movably attached along a direction crossing to said feeding direction at least.

3. The fixing apparatus according to the claim 2, which further comprises urging means for urging the pressing roller toward the fixing roller so as to contact thereto.

4. The fixing apparatus according to one of the preceding claims 1 to 3, wherein said fixing belt includes an endless belt base of a heat transmission material and a separating layer coated on an outer circumferential surface of the endless belt base.

5. The fixing apparatus according to the claim 4, wherein said endless belt base is made of metal belt.

6. The fixing apparatus according to the claim 5, wherein said endless belt base is made of electro-formed nickel.

7. The fixing apparatus according to the claim 4, wherein said endless belt base is made of synthetic resin.

8. The fixing apparatus according to the claim 7, wherein said synthetic resin has an electro-conductivity.

9. The fixing apparatus according to the claim 7, wherein said endless belt base is made of polyimide.

10. The fixing apparatus according to the claim 9, wherein said polyimide has an electro-conductivity.

11. The fixing apparatus according to the claim 1, wherein said heating source is housed in said heating roller, and said fixing belt is heated by the heating roller which is heated by said heating source.

12. A fixing apparatus, comprising:

a fixing roller;

a pressing roller rollingly contacting the fixing roller;

a heating roller positioned on an upstream side of said fixing roller with respect to a feeding direction in which a sheet carrying an unfixed toner image thereon is fed;

a heating source being remote from said fixing roller;

a fixing belt trained around said heating roller and said fixing roller for transferring heat from said heating source to preheat the unfixed toner image on said sheet before said sheet passes through a rolling contact region defined between said fixing roller and pressing roller;

driving means for rotatably driving said pressing roller to endlessly travel the fixing belt upon the rotation of said pressing roller;

a pressing mechanism for urging said pressing roller toward said fixing belt, said pressing roller being inclined by a predetermined angle in a feeding direction with respect to a vertical line passing through a central position of said fixing roller; and urging means for urging the pressing roller toward the fixing roller so as to contact thereto, wherein said pressing roller is movably attached along a direction crossing to said feeding direction at least, and said driving means includes a driven gear coaxially fixed to said pressing roller, and a driving gear intermeshed with said driven gear, said driven gear constructed so as to revolve around the driving gear while maintaining an intermeshing condition between the driving gear and driven gear.

13. A fixing apparatus, comprising:

a fixing roller;

a pressing roller rollingly contacting the fixing roller;

a heating roller positioned on an upstream side of said fixing roller with respect to a feeding direction in which a sheet carrying an unfixed toner image thereon is fed;

a heating source being remote from said fixing roller;

a fixing belt trained around said heating roller and said fixing roller for transferring heat from said heating source to preheat the unfixed toner image on said sheet before said sheet passes through a rolling contact region defined between said fixing roller and pressing roller;

driving means for rotatably driving said pressing roller to endlessly travel the fixing belt upon the rotation of said pressing roller;

a pressing mechanism for urging said pressing roller toward said fixing belt, said pressing roller being inclined by a predetermined angle in a feeding direction with respect to a vertical line passing through a central position of said fixing roller; and urging means for urging the pressing roller toward the fixing roller so as to contact thereto, wherein said pressing roller is movably attached along a direction crossing to said feeding direction at least, said driving means includes a driven gear coaxially fixed to said pressing roller, and a driving gear intermeshed with said driven gear, said driven gear constructed so as to revolve around the driving gear while maintaining an intermeshing condition between the driving gear and driven gear, said driving gear is rotatably supported about a predetermined stationary axis, and said driven gear is rotatably supported on a distal end of a swing arm, a proximal end of said swing arm being rotatably supported about said predetermined stationary axis.

14. The fixing apparatus according to one of the preceding claims 12 or 13, wherein said fixing belt includes an endless belt base of a heat transmission material and a separating layer coated on an outer circumferential surface of the endless belt base.

15. The fixing apparatus according to the claim 14, wherein said endless belt base is made of metal.

16. The fixing apparatus according to the claim 15, wherein said endless belt base is made of electro-formed nickel.

17. The fixing apparatus according to the claim 14, wherein said endless belt base is made of synthetic resin.

18. The fixing apparatus according to the claim 17, wherein said synthetic resin has electro-conductivity.

19. The fixing apparatus according to the claim 17, wherein said endless belt base is made of polyimide.

20. The fixing apparatus according to the claim 19, wherein said polyimide has electro-conductivity.

21. The fixing apparatus according to the claims 12 or 13, wherein said heating source is housed in said heating roller, and said fixing belt is heated by the heating roller which is heated by said heating source.

* * * * *